US005254018A

United States Patent [19]

Sawada

[11] Patent Number: 5,254,018

[45] Date of Patent: Oct. 19, 1993

[54] CONNECTOR

[75] Inventor: Hisashi Sawada, Mie, Japan

[73] Assignee: Sumitomo Wiring Systems, Ltd., Mie, Japan

[21] Appl. No.: 913,698

[22] Filed: Jul. 16, 1992

[30] Foreign Application Priority Data

Aug. 1, 1991 [JP] Japan ..... 3-193165

[51] Int. Cl.[5] ..... H01R 13/64

[52] U.S. Cl. ..... 439/680; 439/901

[58] Field of Search ..... 439/677, 678, 679, 680, 439/681, 901; 403/13, 405.1

[56] References Cited

U.S. PATENT DOCUMENTS

| | | | |
|---|---|---|---|
| 4,913,665 | 4/1990 | Sacksen | 439/680 X |
| 4,913,667 | 4/1990 | Muz | 439/680 X |
| 4,936,943 | 6/1990 | Kubis et al. | 439/680 X |
| 4,986,769 | 1/1991 | Adams, III et al. | 439/681 |

FOREIGN PATENT DOCUMENTS

| | | | |
|---|---|---|---|
| 235338 | 9/1987 | European Pat. Off. . | |
| 235339 | 9/1987 | European Pat. Off. . | |
| 392088 | 10/1990 | European Pat. Off. . | |
| 2193051 | 1/1988 | United Kingdom | 439/678 |

*Primary Examiner*—Larry I. Schwartz
*Assistant Examiner*—Khiem Nguyen
*Attorney, Agent, or Firm*—Sughrue, Mion, Zinn, Macpeak & Seas

[57] ABSTRACT

A connector 10 comprises a main connector body 1 and a plurality of mating connector bodies 2 having a pair of poles in each set of divided conductor circuits. The main connector body 1 is provided with four terminals 4 with two pairs of poles in a casing 3. The four terminals project into a cavity 5. Ribs 6 are disposed adjacent to the terminals in the cavity 5. Each rib is disposed in a different position in connection with the mating connector bodies 2. They have three cavities 15 with the same shape. Female terminals 9 are inserted into two of the cavities 15 and are connected to wires 20, respectively.

2 Claims, 5 Drawing Sheets

CONNECTOR

BACKGROUND OF THE INVENTION

1. Field of the Invention

This invention relates to a connector used for an electrical connection in various kinds of electrical wiring.

2. Statement of the Prior Art

Various kinds of connectors are used in electrical wiring, in particular, various kinds of electrical devices for a motorcar. There are known connectors in which a housing having many terminals with many sets of poles receives a mating connector body having many terminals or in which a housing having many terminals receives many mating connector bodies each having a set or sets of terminals with a set or sets of poles.

In the former connector out of the above prior connectors, a large force is required for coupling the terminals, since the terminals in the mating connector body must be connected to the terminals in the housing at the same time. As the terminals having many poles must be disposed in a housing, the housing becomes bulky and it is difficult to connect all the terminals with an even force thus resulting in wrenching of the terminals.

In the latter connector, if all the mating connector bodies are formed into the same shape, the mating connector bodies will be improperly coupled to the housing. In order to prevent improper coupling, mating connector bodies are provided with ribs disposed in different positions in the bodies. However, this requires mating connector bodies to have different shapes and plural parts.

SUMMARY OF THE INVENTION

An object of the present invention is to provide a connector which comprises a main connector body and a plurality of mating connector bodies, the main connector body being provided with ribs in different positions in connection with the mating connector bodies to prevent improper coupling, and the mating connector bodies being formed into the same shape to be made at a lower cost.

In order to accomplish the above object, the connector in accordance with the present invention comprises a main connector body having a plurality of sets of male terminals in a casing, and a plurality of mating connector bodies having a set of female terminals connected to each set of divided conductor circuits. Each of the mating connector bodies is coupled to a respective coupling space in the main connector body. Sets of male terminals are provided in coupling spaces in the main connector body to be connection with sets of divided conductor circuits. The main connector body is provided with ribs adjacent to sets of male terminals in the coupling spaces. Each of the mating connector bodies is provided with a vacant cavity adjacent to the female terminals in connection with the rib. Each rib is disposed in a different position in each of the coupling spaces so that the rib is opposed to the vacant cavity in each of the mating connector bodies.

The connector in accordance with the present invention provides an electrical connection when the mating connector bodies are properly coupled to the main connector body.

If the mating connector body is inserted into a wrong coupling space in the main connector body by mistake, the rib in the coupling space prevents the female terminals in the mating connector body from being inserted into the space.

DETAILED DESCRIPTION OF THE PREFERRED EMBODIMENTS

Referring now to FIGS. 1 to 6, an embodiment of a connector 10 in accordance with the present invention will be explained below.

Figure 1:
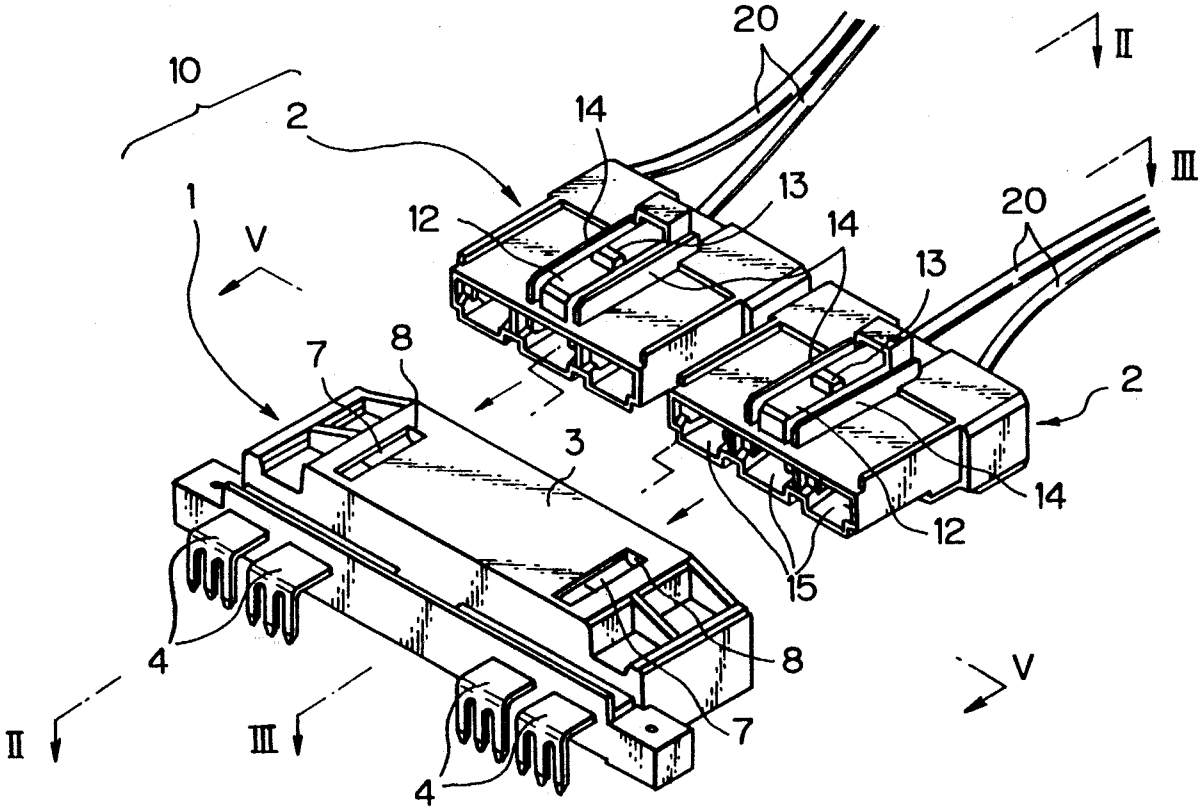
FIG. 1 is an exploded perspective view of an embodiment of a connector in accordance with the present invention.

FIG. 1 shows a general perspective view of an embodiment of the connector 10 of the present invention. The connector 10 has four poles of terminals as an example. For instance, in an electrical wiring for a motorcar, the connector is used to connect a main harness through a printed wiring base plate to various kinds of electrical devices.

The connector 10 comprises a main connector body 1 and a mating connector body 2. The main connector body 1 has two sets of male terminals 4 with two poles disposed in a casing 3 made of a resin. An end of each terminal 4 projects in the casing 3.

Figure 6:
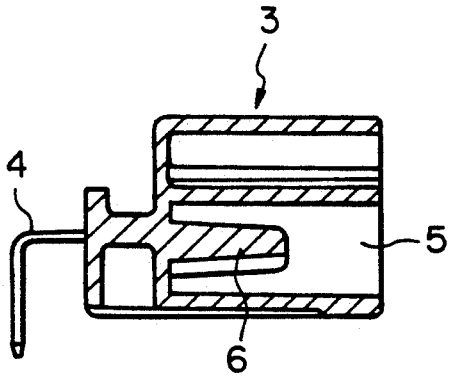
FIG. 6 is a cross sectional view taken along a line VI—VI in FIG. 5.
Figure 5:
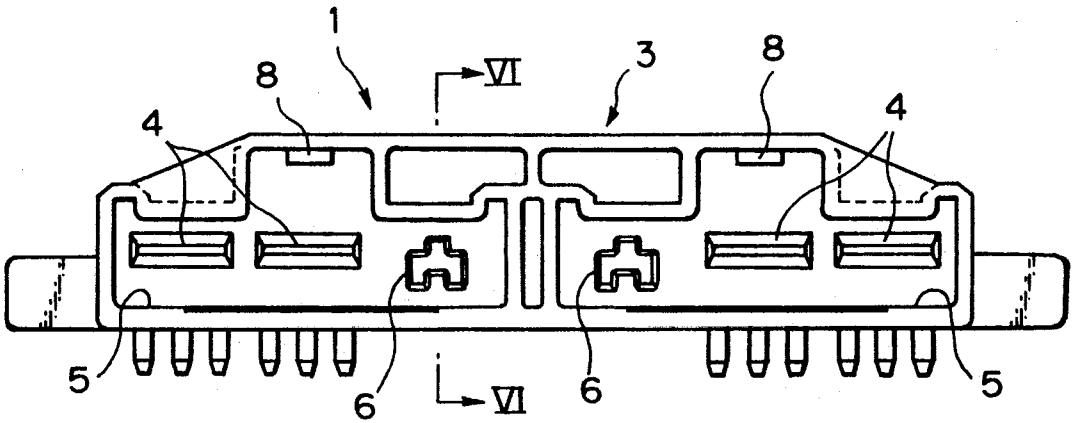
FIG. 5 is a front view of a main connector body taken along a line V—V in FIG. 1.

As shown in FIG. 5, a T-shaped coupling space or cavity 5 is formed in the casing 3 in connection with each set of terminals 4, which project in the cavity 5. A rib 6 is provided adjacent to the set of terminals 4 in each of the coupling spaces or cavities 5. The rib 6 is integrally formed with the casing 3 made of the resin. FIG. 6 shows a cross sectional view of the rib 6. Also, as shown in FIG. 1, the casing 3 is provided with a slot 7 in a top wall of each cavity 5. A slippage preventer 8 is formed in an end of the slot 7.

Figure 2:
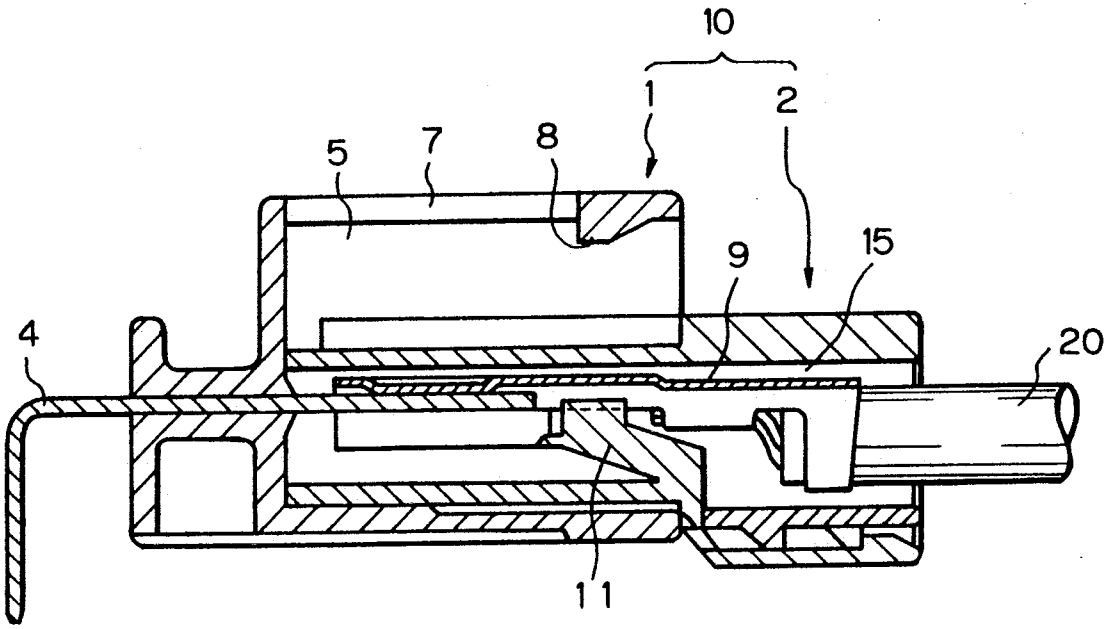
FIG. 2 is a cross sectional view taken along a line II—II in FIG. 1, which shows a position for inserting terminals.
Figure 3:
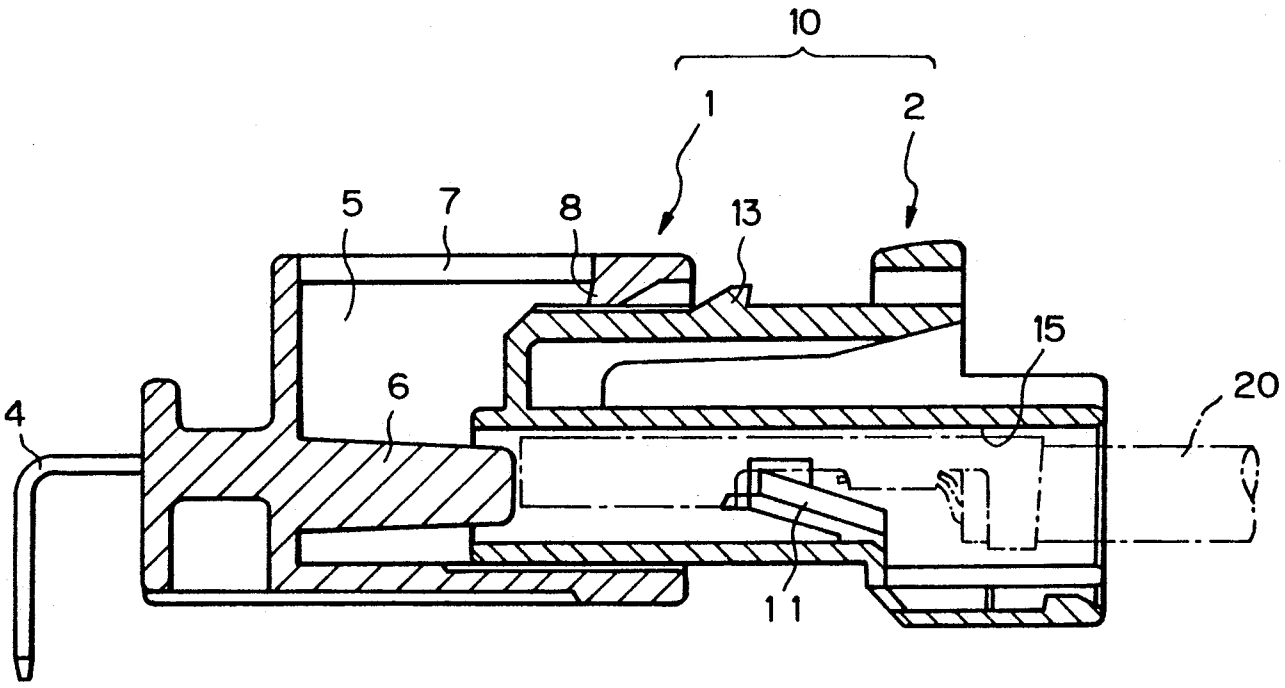
FIG. 3 is a cross sectional view taken along a line III—III in FIG. 1, which shows a position with no terminals.
Figure 4:
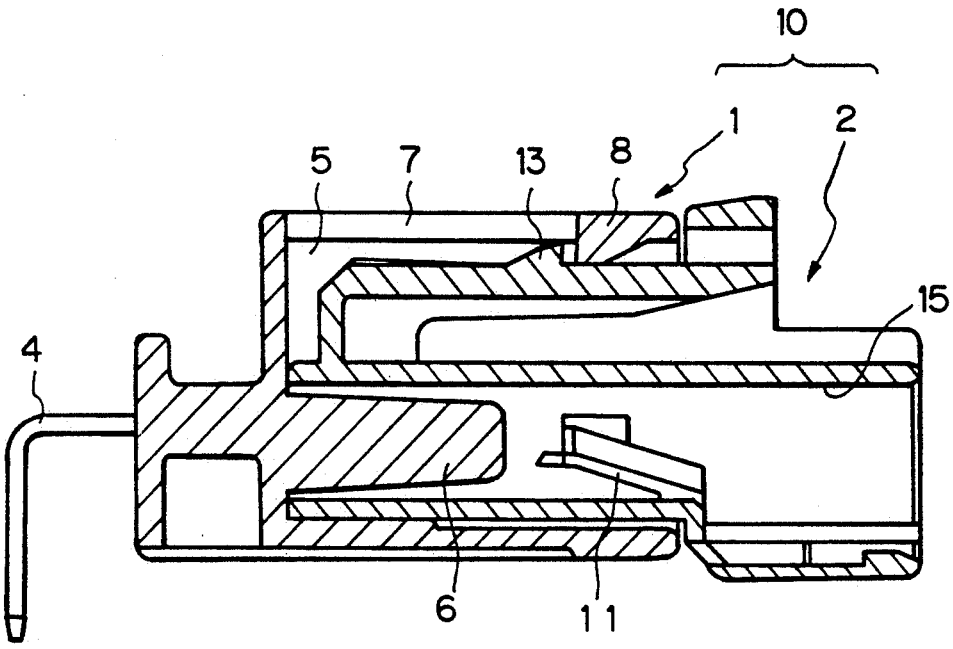
FIG. 4 is a cross sectional view similar to FIG. 3, which shows a position of the connector completely coupled.

Two mating connectors 2 are provided in connection with the two sets of terminals 4 in the main connector body 1, respectively. Each mating connector 2 has two female terminals 9 with two poles. Each of two wires ore cords 20 is connected to each of the female terminals 9 in each of the mating connector body 2, as shown in FIG. 2. The mating connector bodies are formed into the same cross section and have three cavities 15, respectively.

The female terminal 9 is provided in the cavity 15 in connection with the male terminal 4 in the main connector body 1. The female terminal 9 is prevented from slipping out of the cavity 15 by a projection 11 formed therein. When the mating connector body 2 is inserted into the cavity 5 in the main connector body 1 as shown in FIG. 2, the male terminal 4 is inserted into the female terminal 9 to make an electrical connection.

Further, the mating connector body 2 is provided with another cavity 15 adjacent to the cavity 15 having the female terminal 9 (FIG. 2), as shown in FIG. 1. Thus, there are three cavities in the body 2. The last cavity 15 has no female terminals and receives the rib 6 in the main connector body 1 when the body 2 is properly coupled to the body 1 (see FIGS. 3 and 4).

The mating connector body 2 is provided with a movable piece 12 on a top wall thereof. The movable piece 12 has a projection 13 on a middle portion thereof. When the mating connector body 2 is inserted into the main connector body 1, the movable piece 12 engages with a vertical groove in the T-shaped cavity 5 in the main connector body 1 (see FIG. 5) to guide the mating connector body 2 in the cavity 5. When the body 2 is moved to the complete coupling position in the main body 1, the projection 13 on the movable piece 12 engages with the slippage preventer 8 formed in the end of the slot 7 to lock the body 2 in the main body 1. If the mating connector body 2 should be disconnected from the main connector body 1, the projection 13 is disengaged from the slippage preventer 8 by pushing down and forward a rear end of the movable piece 12. Consequently, the body 2 can be readily drawn out of the main body 1.

In the connector 10 thus constructed above, when the mating connector body 2 is coupled to the main connector body 1 as shown in FIG. 2, the terminals 4 and 9 are connected to each other to form an electrical connection in each pole. A proper electrical connection can be accomplished so long as the mating connector body 2 is inserted into the proper cavity 5 in the corresponding main connector body 1.

If the mating connector body 2 is inserted into a wrong cavity 5, for example, if the body 2 to be inserted into the left side cavity 5 in FIG. 5 is inserted into the right side cavity 5 by mistake, the mating connector body 2 cannot be completely inserted into the cavity 5 since the female terminal 9 in the body 2 abuts on the rib 6 in the cavity 5. Accordingly, the connector 10 can prevent the mating connector body 2 from being inserted into the wrong cavity in the main connector body 1.

Although the male terminals 4 have two sets of two poles in the above embodiment, it will be apparent to a skilled person in the art that the present invention can be applied to the terminals having three sets of three poles.

In the connector in accordance with the present invention, electrical connection can be obtained between the proper terminals, and ribs are provided in the vacant cavity in the main connector body to prevent the mating connector body from being inserted into the vacant cavity. The mating connector bodies can be formed into the same shape without providing different ribs thus being able to be produced at relatively low cost.

What is claimed is:

1. A connector comprising:

a main connector body comprising a front face, a plurality of coupling spaces, and a plurality of sets of male terminals, with each set of said male terminals being provided in a corresponding one of said coupling spaces in said main connector body; and a plurality of mating connector bodies having a set of female terminals connected to sets of divided conductor circuits, each of said mating connector bodies being coupled to one of said coupling spaces in said main connector body;

each set of said male terminals being provided in connection with said sets of said divided conductor circuits, said male terminals having free ends which extend toward said mating connector bodies but which remain within said coupling spaces so as not to project beyond the front face of said main connector body;

said main connector body being provided with ribs adjacent to each set of said male terminals in each coupling space;

each of said mating connector bodies being provided with a vacant cavity adjacent to said female terminals in connection with a corresponding one of said ribs;

each rib being disposed in a different position in each of said coupling spaces so that the rib is opposed to the vacant cavity in each mating connector body.

2. The connector according to claim 1, wherein said ribs are of integral, one-piece construction with said main connector body.

* * * * *